US008859904B2

(12) United States Patent
Konya

(10) Patent No.: US 8,859,904 B2
(45) Date of Patent: Oct. 14, 2014

(54) FLEXIBLE FLAT CABLE

(75) Inventor: Masamitsu Konya, Hitachi (JP)

(73) Assignee: Hitachi Metals, Ltd, Tokyo (JP)

( * ) Notice: Subject to any disclaimer, the term of this patent is extended or adjusted under 35 U.S.C. 154(b) by 309 days.

(21) Appl. No.: 13/317,995

(22) Filed: Nov. 2, 2011

(65) Prior Publication Data

US 2012/0199376 A1 Aug. 9, 2012

(30) Foreign Application Priority Data

Feb. 8, 2011 (JP) ..... 2011-025006

(51) Int. Cl.
*H01B 7/08* (2006.01)

(52) U.S. Cl.
CPC ..... *H01B 7/0838* (2013.01); *H01B 7/0861* (2013.01); *H01B 7/0869* (2013.01)
USPC ..... 174/117 FF

(58) Field of Classification Search
USPC ..... 174/117 FF, 117 M
See application file for complete search history.

(56) References Cited

U.S. PATENT DOCUMENTS 7,037,569 B2 * 5/2006 Curro et al. ..... 428/138
7,554,038 B2 * 6/2009 Oga et al. ..... 174/102 R
8,138,421 B2 * 3/2012 Takamatsu et al. ..... 174/117 F
8,338,709 B2 * 12/2012 Kodama et al. ..... 174/110 R
2002/0064631 A1 * 5/2002 Wakabayashi et al. ..... 428/195
2010/0166375 A1 * 7/2010 Parris ..... 385/113
2011/0100673 A1 5/2011 Takamatsu et al.

FOREIGN PATENT DOCUMENTS

JP 10-012211 * 1/1998
JP 2000-279282 * 10/2000
JP 2009-170291 A 7/2009
WO WO 2008/126537 * 10/2008

* cited by examiner

*Primary Examiner* — Chau N Nguyen
(74) *Attorney, Agent, or Firm* — McGinn IP Law Group, PLLC

(57) ABSTRACT

A flexible flat cable includes a plurality of conductors, a nonwoven fabric layer provided on an outer surface of an insulation layer, and a shield layer provided on the nonwoven fabric layer. The nonwoven fabric layer includes a nonwoven fabric having a plurality of recessed portions formed on a surface thereof, the recessed portions being each enclosed by two opposite long sides and two opposite short sides, and the nonwoven fabric has an embossed shape which satisfies the following relation: $2d<b<2a<c$ where the long sides of the recessed portions are a[mm] in length, the short sides of the recessed portions are d[mm] in length, a center-to-center distance between the adjacent recessed portions parallel arranged in a direction of the short sides is c[mm], and a center-to-center distance between the adjacent recessed portions parallel arranged in a direction of the long sides is b[mm].

3 Claims, 3 Drawing Sheets

1 FLEXIBLE FLAT CABLE
2 CONDUCTOR
3 INSULATION LAYER
4 NONWOVEN FABRIC LAYER
5 SHIELD LAYER

1 FLEXIBLE FLAT CABLE
2 CONDUCTOR
3 INSULATION LAYER
4 NONWOVEN FABRIC LAYER
5 SHIELD LAYER

41 NONWOVEN FABRIC
42 RECESSED PORTION

FLEXIBLE FLAT CABLE

The present application is based on Japanese Patent Application No. 2011-025006 filed on Feb. 8, 2011, the entire contents of which are incorporated herein by reference.

BACKGROUND OF THE INVENTION

1. Field of the Invention

The invention relates to a flexible flat cable, in particular, to a flexible flat cable having a shield layer which is used as a wiring material for transmitting an electrical signal in electronic equipments.

2. Description of the Related Art

In general, a flexible flat cable is widely used as a jumper wire (a fixed wiring) between circuits in various electric and electronic equipments or as a wiring material wired to a movable portion in the electric and electronic equipments in place of a flexible printed-wiring board by taking advantage of plasticity (flexibility) thereof. Particularly in recent years, an application as a wiring material for wiring to a print head portion of a PC inkjet printer or a pick-up portion of CD-ROM drive, car navigation or DVD (Digital Versatile Disc) player, etc., is proceeding.

In recent years, downsizing, weight reduction and multiple functions of electronic equipments have progressed. Therefore, a wiring material which allows high-speed and high-capacity transmission is demanded. Since electrical signal noise in electronic equipments is increased due to transmission frequency, a wiring material having an excellent shielding property is particularly required. Furthermore, the wiring material is required to have characteristic impedance which matches that of the electronic equipment.

As a conventional flexible flat cable having a shield layer which allows characteristic impedance matching, JP-A-2009-170291 discloses a flexible flat cable which is provided with a nonwoven fabric layer provided on an outer surface of an insulation layer and a shield layer provided on an outer surface of the nonwoven fabric layer.

SUMMARY OF THE INVENTION

As mentioned earlier, a flexible flat cable is conventionally used as a wiring material in electronic equipments, etc., and is now often bent to install in the electronic equipments in accordance with the downsizing of the electronic equipments in recent years. Accordingly, plasticity (flexibility) allowing a bending process for transforming into complex shapes is required for the flexible flat cable.

The flexible flat cable disclosed in JP-A-2009-170291 does not have sufficient flexibility to perform a bending process and a restoring force thereof when being bent is still large. Therefore, it is not possible to maintain a bent shape due to springback, and work to fix a bent portion using a fixing member such as an acetate tape may be required. The necessity of such a fixing member is disadvantageous from the viewpoint of workability and cost performance.

Accordingly, it is an object of the invention to provide a flexible flat cable with further improved flexibility as compared to the conventional flat cable.

(1) According to one embodiment of the invention, a flexible flat cable comprises:

a plurality of conductors arranged in parallel at a predetermined interval;

an insulation layer provided on both surfaces of the conductors;

a nonwoven fabric layer provided on an outer surface of the insulation layer; and a shield layer provided on an outer surface of the nonwoven fabric layer, wherein the nonwoven fabric layer comprises a nonwoven fabric having a plurality of recessed portions formed on a surface thereof, the recessed portions being each enclosed by two opposite long sides and two opposite short sides, and the nonwoven fabric has an embossed shape which satisfies the following relation:

$$2d<b<2a<c$$

where the long sides of the recessed portions are a[mm] in length, the short sides of the recessed portions are d[mm] in length, a center-to-center distance between the adjacent recessed portions parallel arranged in a direction of the short sides is c[mm], and a center-to-center distance between the adjacent recessed portions parallel arranged in a direction of the long sides is b[mm].

In the above embodiment (1) of the invention, the following modifications and changes can be made.

(i) The nonwoven fabric has a basis weight of 50 to 90 $g/m^2$ and a void content of 170 to 280 $cm^3/m^2$.

(ii) The nonwoven fabric comprises a first fiber yarn having a predetermined outer diameter and a second fiber yarn having a larger outer diameter than the first fiber yarn.

(iii) The nonwoven fabric comprises a first layer formed of the first fiber yarn, a second layer formed of the second fiber yarn and provided on both sides of the first layer, and a third layer formed of the first and second fiber yarns and provided between the first and second layers.

(iv) The recessed portions of the nonwoven fabric layer are arranged such that the long sides thereof are arranged along a longitudinal direction of the cable.

(v) The recessed portions of the nonwoven fabric layer are arranged such that the short sides thereof are arranged along a longitudinal direction of the cable.

EFFECTS OF THE INVENTION

According to one embodiment of the invention, a flexible flat cable with further improved flexibility as compared to the conventional flat cable can be provided.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

A preferred embodiment of the invention will be described below in conjunction with the appended drawings.

As a result of the keen examination, the present inventors have found that forming an embossed shape on a surface of a nonwoven fabric constituting a nonwoven fabric layer in a flexible flat cable is important to achieve improvement in flexibility and characteristic impedance matching which are objects of the invention, and thus, the present invention was made based on this knowledge.

Figure 1:
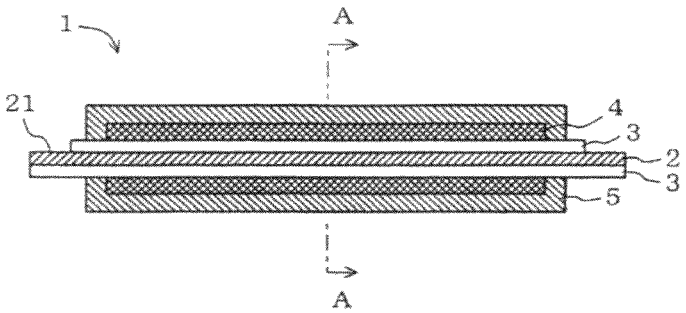
FIG. 1 is a cross sectional view showing a flexible flat cable of the present invention.
Figure 2:
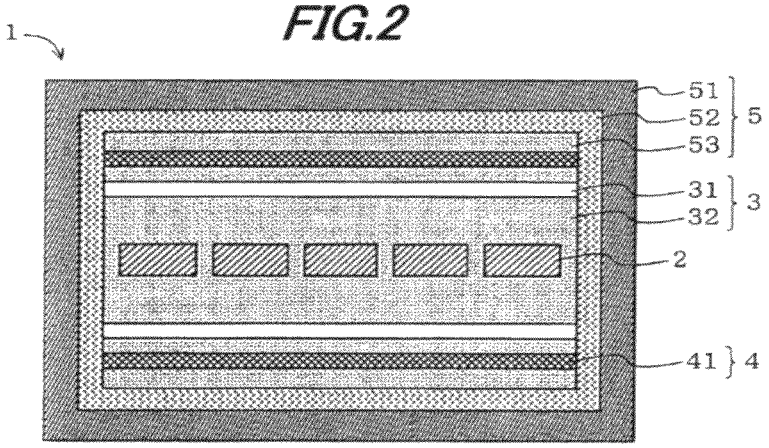
FIG. 2 is a cross sectional view showing a detailed structure of the flexible flat cable taken along line A-A in FIG. 1.

FIG. 1 is a cross sectional view showing a flexible flat cable in a preferred embodiment of the present invention, and FIG. 2 is a cross sectional view showing the flexible flat cable shown in FIG. 1 taken along line A-A.

As shown in FIGS. 1 and 2, a flexible flat cable 1 in the present embodiment is provided with plural conductors 2 arranged in parallel at predetermined intervals (see FIG. 2), an insulation layer 3 provided on both sides of the conductors 2 to cover the conductors 2, a nonwoven fabric layer 4 provided on an outer surface of the insulation layer 3, and a shield layer 5 provided on an outer surface of the nonwoven fabric layer 4.

A detailed structure of each layer will be described referring to FIG. 2.

As shown in FIG. 2, the insulation layer 3 is formed of an insulating film with adhesive in which an adhesive 32 is applied to a surface of a plastic insulating film 31. The conductor 2 is sandwiched from both sides by the insulating film so that the adhesive 32 adheres to the conductor 2, thereby forming the insulation layer 3.

The material for the insulating film 31 includes, e.g., polyethylene terephthalate, polyethylene naphthalate and polyphenylene sulfide, etc., and it is desirable to use any one of the above. In addition, it is desirable that an adhesive in which an additive such as a flame retardant is added to, e.g., polyester resin or polyolefin resin be used as the adhesive 32.

Edges of the insulation layer 3 as well as those of the conductor 2 are exposed from the nonwoven fabric layer 4 and the shield layer 5, and one surface of the conductor 2 is exposed by peeling off one side of the exposed insulation layer 3. This makes the exposed one surface of conductor 2 serve as a terminal 21 (see FIG. 1).

Figure 3A:
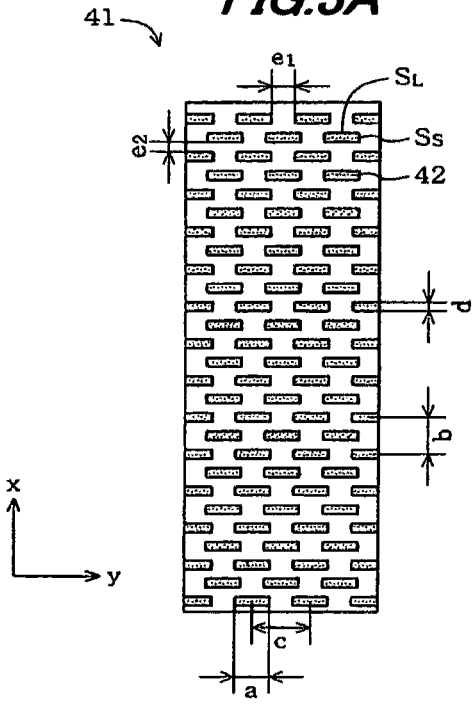
FIGS. 3A and 3B are plan views showing examples of a nonwoven fabric constituting a nonwoven fabric layer of the flexible flat cable in FIG. 1.
Figure 3B:
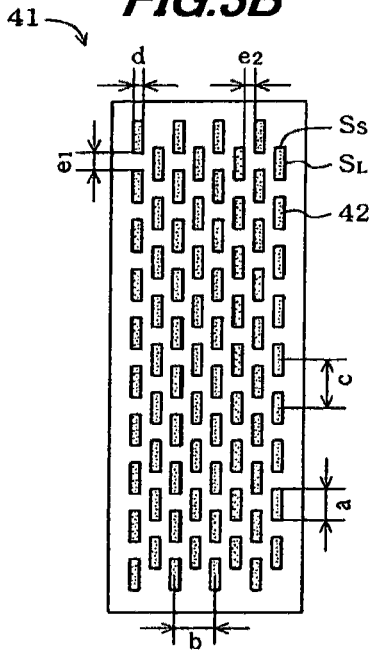

As shown in FIGS. 3A and 3B, the nonwoven fabric layer 4 is formed of a nonwoven fabric 41 in which plural recessed (embossed) portions 42, each of which is enclosed by a pair of opposite long sides $S_L$ and a pair of opposite short sides $S_S$, are formed on the surface thereof. The nonwoven fabric 41 has an embossed shape which satisfies the relation of $2d<b<2a<c$, where a length of the long side $S_L$ of the recessed portion 42 is a[mm], a length of the short side $S_S$ of the recessed portion 42 is d[mm], a center-to-center distance between the two adjacent recessed portions 42 which are arranged in parallel along a short side direction (a direction of arranging the short sides $S_S$ of a recessed portion 42, i.e., a y-direction in FIG. 3A and an x-direction in FIG. 3B) is c[mm] and a center-to-center distance between the two adjacent recessed portions 42 which are arranged in parallel along a long side direction (a direction of arranging the long sides $S_L$ of a recessed portion 42, i.e., an x-direction in FIG. 3A and a y-direction in FIG. 3B). In the nonwoven fabric layer 4, an adhesive such as an olefin-based adhesive is applied to the nonwoven fabric 41 on a surface thereof in contact with the insulation layer 3.

The use of a nonwoven fabric having such an embossed shape allows a restoring force of a bent flexible flat cable to be reduced. This facilitates to maintain the flexible flat cable in a bent shape.

At this time, it is preferable that distances $e_1$ and $e_2$ between two adjacent opposite recessed portions 42 be 1 to 3 mm. The reason therefor is that the distances $e_1$ and $e_2$ in this range allow a stress during bending (a restoring force) to be most reduced.

Figure 4:
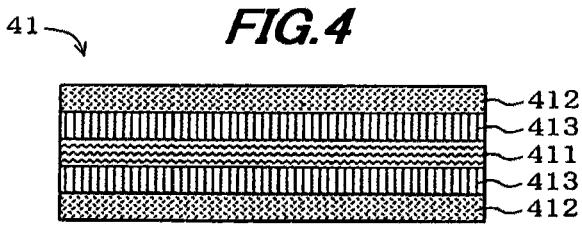
FIG. 4 is a cross sectional view showing a detailed structure of the nonwoven fabric constituting the nonwoven fabric layer of the flexible flat cable in FIG. 1.

It is desirable that the nonwoven fabric 41 be formed of a spunbond nonwoven fabric, and be formed of especially a spunbond nonwoven fabric composed of a first fiber yarn having a predetermined outer diameter and a second fiber yarn having a larger outer diameter than the first fiber yarn. In more detail, the nonwoven fabric 41 has a first layer 411 formed of the first fiber yarn, a second layer 412 formed of the second fiber yarn and provided on the both sides of the first layer 411, and a third layer 413 formed of the first and second fiber yarns and provided between the first layer 411 and the second layer 412, as shown in FIG. 4.

The outer diameter (fiber diameter) of the first fiber yarn which constitutes the first layer 411 and the third layer 413 is desirably not less than 0.001 mm and not more than 0.010 mm. Meanwhile, the outer diameter (fiber diameter) of the second fiber yarn which constitutes the second layer 412 and the third layer 413 is desirably not less than 0.011 mm and not more than 0.040 mm.

Since the nonwoven fabric 41 is formed by laminating layers formed of plural fiber yarns having different outer diameters as described above, it is possible to eliminate variation in void size in the nonwoven fabric 41 and to obtain more stable characteristic impedance.

In addition, the nonwoven fabric 41 preferably has a basis weight of 50 to 90 $g/m^2$ as well as a void content of 170 to 280 $cm^3/m^2$.

When the basis weight of the nonwoven fabric 41 is less than 50 $g/m^2$, there is a possibility that the characteristic impedance does not fall within the range of 100±10Ω, hence, it is difficult to match the characteristic impedance to that of the equipment. On the other hand, when the basis weight of the nonwoven fabric 41 is more than 90 $g/m^2$, the flexibility decreases with an increase in the basis weight. It should be noted that the basis weight as used herein indicates the total mass of the first fiber yarn and the second fiber yarn per square meter.

In addition, since the nonwoven fabric 41 has a void content of 170 to 280 $cm^3/m^2$, the dielectric constant thereof can fall within the range of 1.4 to 1.7. As a result, in the case where the basis weight of the nonwoven fabric 41 is 50 to 90 $g/m^2$ and the dielectric constant is within the range of 1.4 to 1.7, the value of the characteristic impedance of the flexible flat cable 1 can be within the range of 100±10Ω with good reproducibility. The void content of the nonwoven fabric is a measure of the void included in the nonwoven fabric per square meter and indicates a ratio of volume of the void included in the nonwoven fabric to the total volume of the nonwoven fabric.

The nonwoven fabric layer 4 is formed of the nonwoven fabric 41 as described above and is configured such that the long sides $S_L$ of the recessed portions 42 are arranged along a longitudinal direction of the cable or such that the short sides $S_S$ of the recessed portions 42 are arranged along a longitudinal direction of the cable.

The shield layer 5 is formed of a shield material in which a metal foil 52 is provided on a surface of a plastic insulating film 51 and an adhesive 53 is applied to a surface of the metal foil 52.

The shield layer 5 is formed by, e.g., winding the shield material around the surface of the nonwoven fabric layer 4 such that the adhesive 53 of the shield material is in contact with the nonwoven fabric layer 4 and that the insulating film 51 is the outermost layer.

Similarly to the material of the insulating film 31 constituting the insulation layer 3, the material of the insulating film 51 includes, e.g., polyethylene terephthalate, polyethylene naphthalate and polyphenylene sulfide, etc., and it is desirable to use any one of the above.

Aluminum foil is most suitable as a material for the metal foil 52 in order to suppress an increase in attenuation especially in a high-frequency band.

Similarly to the adhesive 32 constituting the insulation layer 3, it is desirable that an adhesive in which an additive such as flame retardant is added to polyester resin or polyolefin resin be used as the adhesive 53.

When a structure, in which the flexible flat cable 1 is grounded to a ground metal layer at an end portion thereof, is employed at the time of winding the shield material, it is desirable that an adhesive having conductive properties be used as the adhesive 53.

The flexible flat cable 1 described above allows flexibility to be further improved as compared to the conventional art and enables characteristic impedance to match that of an electronic equipment.

EXAMPLES

In order to verify the effect of the invention, two types of flexible flat cable having a shield layer were experimentally made as Example and Comparative Example shown in Table 1, and characteristic impedance and bending stress thereof were measured.

TABLE 1

| | Example | Comparative Example |
|---|---|---|
| Nonwoven fabric layer | Nonwoven fabric I | Nonwoven fabric II |
| Thickness (mm) | 0.2 | 0.1 |
| Stress (kgf) | 0.20 | 0.32 |
| Characteristic impedance | Passed | Passed |
| Dimension of Recessed portion | (a): 2.5<br>(b): 3.4<br>(c): 5.4<br>(d): 0.4 | (a): 0.5<br>(b): 1.0<br>(c): 1.0<br>(d): 0.5 |

Characteristic Impedance Measurement

For measuring the characteristic impedance, after ground metal layers were attached to both ends of the fabricated flexible flat cable, a measuring plug (FX16M1/51, manufactured by Hirose Electric Co., Ltd.) was electrically connected to the ground metal layer. After that, the flexible flat cable was inserted between and connected to two evaluation substrates, and the characteristic impedance in differential mode was measured by an oscilloscope (DCA86100B, manufactured by Agilent Technologies). Then, the characteristic impedance value obtained by the measurement falling within a range of 100±10Ω was judged as "Passed".

Bending Stress Test

Figure 5:
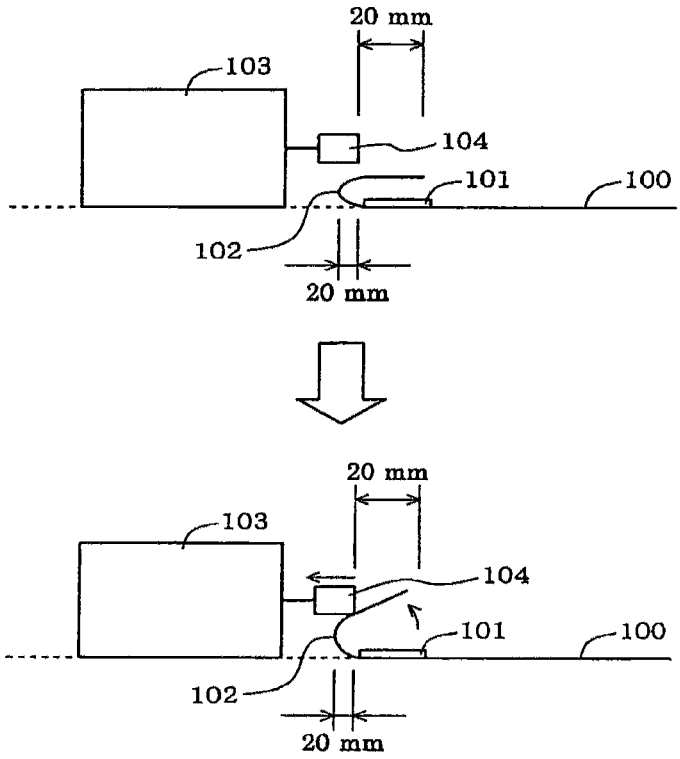
FIG. 5 is an explanatory diagram illustrating a stress measurement method in Example.

In the bending stress test, the fabricated flexible flat cable 100 was linearly placed on a test board and was subsequently fixed by a 20 mm-width tape 101 at a position 40 mm from the edge, as shown in FIG. 5. Next, the flexible flat cable 100 was bent 180° by folding back a portion from the position fixed by the tape 101 to the edge so that a length of a curved portion 102 is 20 mm, and this state was maintained. After that, a push-pull scale 103 (FGC-5B, manufactured by NIDEC-SHIMPO CORPORATION) was placed on the test board so that an edge of a measuring section 104 thereof is arranged at a position 20 mm away from the edge of the flexible flat cable 100, and a force of the flexible flat cable 100 to push the push-pull scale 103 when releasing the bent state was measured as a bending stress. Then, less than 0.26 kgf of the bending stress value obtained by the measurement was judged as "Passed".

Examples

Fifty one tin-plated soft copper flat wires each having a thickness of 0.035 mm and a width of 0.3 mm were prepared as conductors, the conductors were arranged in parallel with a conductor pitch (a distance between each conductor) of 0.5 mm and an insulation layer was subsequently formed so as to sandwich the parallel-arranged conductors between two 0.06 mm-thick insulating films made of polyethylene terephthalate having an adhesive attached thereon so that adhesives are bonded each other. After that, a nonwoven fabric layer was formed so as to sandwich the insulation layer from both sides using two nonwoven fabrics I (spunbond nonwoven fabrics) having a layer structure shown in FIG. 4 and plural recessed portions formed on the surface thereof so that the surfaces of the nonwoven fabrics to which the adhesive adheres are in contact with the insulation layer, and subsequently, a shield layer was formed by helically winding a shield material (adhesive/aluminum foil/insulating film=0.01 min/0.007 mm/0.009 mm) around the nonwoven fabric layer, thereby fabricating a flexible flat cable having a cable length of about 300 mm. Note that, the nonwoven fabric I has a basis weight of 50 g/m$^2$ and a void content of 170 cm$^3$/m$^2$. Dimensions (a) to (d) of the recessed portion formed on the surface are respectively (a)=2.5 mm, (b)=3.4 mm, (c)=5.4 mm and (d)=0.4 mm.

Comparative Examples

Fifty one tin-plated soft copper flat wires each having a thickness of 0.035 mm and a width of 0.3 mm were prepared as conductors, the conductors were arranged in parallel with a conductor pitch (a distance between each conductor) of 0.5 mm and an insulation layer was subsequently formed so as to sandwich the parallel-arranged conductors between two 0.06 mm-thick insulating films made of polyethylene terephthalate having an adhesive attached thereon so that adhesives are bonded each other. After that, a nonwoven fabric layer was formed so as to sandwich the insulation layer from both sides using two nonwoven fabrics II (spunbond nonwoven fabrics) having plural recessed portions formed on the surface thereof so that the surfaces of the nonwoven fabrics to which the adhesive adheres are in contact with the insulation layer, and subsequently, a shield layer was formed by helically winding a shield material (adhesive/aluminum foil/insulating film=0.01 mm/0.007 mm/0.009 mm) around the nonwoven fabric layer, thereby fabricating a flexible flat cable having a cable length of about 300 mm. Note that, the nonwoven fabric II has a basis weight of 100 g/m$^2$ and a void content of 290 cm$^3$/m$^2$. Dimensions (a) to (d) of the recessed portion formed on the surface are respectively (a)=0.5 mm, (b)=1.0 mm, (c)=1.0 mm and (d)=0.5 mm. In addition, the nonwoven fabric II is thinner than the nonwoven fabric I.

It should be noted that (a) to (d) in Table 1 correspond to "a" to "d" used for explaining the nonwoven fabric 41.

The flexible flat cables using the nonwoven fabrics I and II each satisfied the characteristic impedance value of 100±10Ω.

In the evaluation of the bending stress, it was found that the bending stress value in Example using the nonwoven fabric I is smaller. On the other hand, it is understood that Comparative Example has a higher bending stress value than Example even though the nonwoven fabric II which is thinner than the nonwoven fabric I is used. Accordingly, the form of the embossed shape formed on the surface of the nonwoven fabric in the invention is defined as described above. That is, it was verified that the embossed shape satisfying the relation of "2d<b<2a<c" improves flexibility.

It is believed that the factor that reduces stress is a difference in occupancy (density) of the recessed portion on the nonwoven fabric. In the nonwoven fabric II, the occupancy of the recessed portion is high and the fiber yarns are compressed. Therefore, it is presumed that the contact between the fibers is very strong due to the high occupancy of the recessed portion, a repelling force increases and the bending stress becomes high. On the other hand, it is presumed that, since the nonwoven fabric I has adequate voids and the compression of the fiber yarns due to the recessed portion is reduced, a repelling force is reduced and the bending stress decreases.

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

What is claimed is:

1. A flexible flat cable, comprising:

a plurality of conductors arranged in parallel at a predetermined interval;

an insulation layer provided on both surfaces of the conductors;

a nonwoven fabric layer provided on an outer surface of the insulation layer; and a shield layer provided on an outer surface of the nonwoven fabric layer, wherein the nonwoven fabric layer comprises a nonwoven fabric including a plurality of recessed portions formed on a surface thereof, the recessed portions being each enclosed by two opposite long sides and two opposite short sides, and the nonwoven fabric has an embossed shape which satisfies the following relation:

$$2d<b<2a<c$$

where the long sides of the recessed portions are a in length, the short sides of the recessed portions are d in length, a center-to-center distance between adjacent recessed portions parallel arranged in a direction of the short sides is c, and a center-to-center distance between the adjacent recessed portions parallel arranged in a direction of the long sides is b[mm], wherein the recessed portions are arranged along plural lines in parallel with the direction of the short sides or the direction of the long sides, wherein the recessed portions are arranged alternately in adjacent lines of the plural lines, wherein the recessed portions are arranged with a same interval in the plural lines, wherein the shield layer comprises a shield material in which a metal foil is provided on a surface of an insulating film and an adhesive is applied to a surface of the metal foil, and wherein the shield material winds around the outer surface of the nonwoven fabric layer such that the adhesive of the shield material is in contact with the nonwoven fabric layer and the insulating film forms the outermost layer.

2. The flexible flat cable according to claim 1, wherein the insulating film comprises one of polyethylene terephthalate, polyethylene naphthalate, and polyphenylene sulfide.

3. The flexible flat cable according to claim 2, wherein the metal foil comprises aluminum.

* * * * *